US009220388B2

(12) United States Patent
Walz et al.

(10) Patent No.: US 9,220,388 B2
(45) Date of Patent: Dec. 29, 2015

(54) METHOD FOR OPERATING A CLEANING APPLIANCE AND CLEANING APPLIANCE FOR IMPLEMENTING THE METHOD

(71) Applicant: Alfred Kaercher GmbH & Co. KG, Winnenden (DE)

(72) Inventors: Juergen Walz, Moeckmuehl (DE); Michael Schuetz, Stuttgart (DE); Frank Nonnenmann, Schorndorf (DE); Gilles Troff, Stuttgart (DE); Samuel Baeuerle, Kirchberg (DE); Dieter Schaible, Murrhardt (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 142 days.

(21) Appl. No.: 13/855,016

(22) Filed: Apr. 2, 2013

(65) Prior Publication Data

US 2013/0247938 A1 Sep. 26, 2013

Related U.S. Application Data

(63) Continuation of application No. PCT/EP2011/066695, filed on Sep. 26, 2011.

(30) Foreign Application Priority Data

Oct. 12, 2010 (DE) ..... 10 2010 042 347

(51) Int. Cl.
*A47L 9/28* (2006.01)
*A47L 11/28* (2006.01)
*A47L 11/40* (2006.01)

(52) U.S. Cl.
CPC ..... *A47L 11/28* (2013.01); *A47L 11/4008* (2013.01); *A47L 11/4011* (2013.01); *A47L 11/4036* (2013.01); *A47L 9/2847* (2013.01)

(58) Field of Classification Search
CPC . A47L 11/4011; A47L 9/2805; A47L 9/2836; A47L 9/2847; A47L 11/28; G05B 19/00; G05B 23/00
USPC ..... 15/319, 339, 383; 340/5.65, 5.8, 5.81
IPC ..... A47L 9/28
See application file for complete search history.

(56) References Cited

U.S. PATENT DOCUMENTS 4,351,078 A 9/1982 Sternberg
4,679,271 A 7/1987 Field et al.

(Continued)

FOREIGN PATENT DOCUMENTS

AT 397 030 1/1994
DE 33 09 967 9/1984

(Continued)

OTHER PUBLICATIONS

Caitlin Cunningham, "How to Make Grout Shine" archived Dec. 2008, <URL: https://web.archive.org/web/20081226005031/http://www.ehow.com/how_2306501_make-grout-shine.html>, 2 pages.

(Continued)

*Primary Examiner* — David Redding
(74) *Attorney, Agent, or Firm* — Lipsitz & McAllister, LLC

(57) ABSTRACT

A method is proposed for operating a cleaning appliance which comprises a control device as well as at least one cleaning element for cleaning a surface which has a memory element. The control device comprises a control memory member and the control device is connected to a reader for reading the memory element. In order to reduce the risk of the user unintentionally using an unsuitable cleaning element, it is suggested that characterizing data distinguishing the type of cleaning element be stored in the memory element, these data being read and evaluated in the period of time from the starting up of the cleaning appliance up to the beginning of the cleaning action of the cleaning element. In addition, a cleaning appliance for implementing the method is suggested.

27 Claims, 1 Drawing Sheet

(56) References Cited

U.S. PATENT DOCUMENTS

| | | | | |
|---|---|---|---|---|
| 5,455,979 | A | 10/1995 | Bores et al. | |
| 5,561,881 | A | 10/1996 | Klinger et al. | |
| 5,615,437 | A | 4/1997 | Takahashi et al. | |
| 5,640,081 | A | 6/1997 | Austin et al. | |
| 5,922,968 | A | 7/1999 | Briscoe | |
| 5,940,928 | A | 8/1999 | Erko | |
| 6,163,915 | A | 12/2000 | Kaczmarz et al. | |
| 6,493,896 | B1 | 12/2002 | Stuchlik et al. | |
| 7,120,961 | B2 | 10/2006 | Boomgaarden et al. | |
| 7,269,877 | B2 | 9/2007 | Tondra et al. | |
| 7,740,707 | B2 * | 6/2010 | Bertram et al. | 134/18 |
| 7,992,245 | B2 | 8/2011 | Schuetz et al. | |
| 8,011,050 | B2 | 9/2011 | Knopow | |
| 8,015,650 | B2 | 9/2011 | Knopow et al. | |
| 2003/0115694 | A1 | 6/2003 | Pace | |
| 2004/0045581 | A1 | 3/2004 | Boomgaarden et al. | |
| 2004/0255409 | A1 | 12/2004 | Hilscher et al. | |
| 2006/0069463 | A1 | 3/2006 | Kim | |
| 2006/0103523 | A1 | 5/2006 | Field | |
| 2006/0265824 | A1 | 11/2006 | Knopow | |
| 2007/0252719 | A1 | 11/2007 | Ray | |
| 2008/0034515 | A1 | 2/2008 | Hilscher et al. | |
| 2008/0047092 | A1 | 2/2008 | Schnittman et al. | |
| 2008/0099043 | A1 * | 5/2008 | Barnhill et al. | 134/6 |
| 2008/0099045 | A1 | 5/2008 | Glenn et al. | |
| 2008/0178909 | A1 | 7/2008 | Alvestig et al. | |
| 2010/0114372 | A1 * | 5/2010 | Knuth, Jr. et al. | 700/257 |
| 2010/0263141 | A1 | 10/2010 | Schuetz et al. | |
| 2010/0325826 | A1 | 12/2010 | Knopow et al. | |
| 2011/0023918 | A1 | 2/2011 | Kelle et al. | |
| 2012/0084930 | A1 | 4/2012 | Schuetz et al. | |

FOREIGN PATENT DOCUMENTS

| | | |
|---|---|---|
| DE | 3 841 177 | 11/1990 |
| DE | 195 06 552 | 9/1995 |
| DE | 696 08 116 | 1/2001 |
| DE | 10247698 | 4/2004 |
| DE | 10 2004 022 359 | 11/2005 |
| DE | 601 11 306 | 3/2006 |
| DE | 10 2005 041 598 | 1/2007 |
| DE | 699 37 015 | 5/2008 |
| DE | 60 2005 004 218 | 1/2009 |
| DE | 10 2007 050 351 | 4/2009 |
| DE | 10 2008 009 221 | 8/2009 |
| DE | 10 2008 061 251 | 6/2010 |
| EP | 0 649 626 | 4/1995 |
| EP | 0 844 030 | 5/1998 |
| EP | 1 927 408 | 6/2008 |
| EP | 2 177 322 | 4/2010 |
| GB | 2 022 994 | 12/1979 |
| JP | 2000217759 | 8/2000 |
| JP | 2000342496 | 12/2000 |
| WO | WO 97/08984 | 3/1997 |
| WO | WO 2005/006935 | 1/2005 |
| WO | WO 2006/053028 | 5/2006 |
| WO | WO 2007/143214 | 12/2007 |
| WO | WO 2009/049699 | 4/2009 |

OTHER PUBLICATIONS

YorkieTalk.com discussion forum dated Aug. 2007, <URL: http://www.yorkietalk.com/forums/general-yorkshire-terrier-discussion/92938-pet-urine-ceramic-tile-help.html>, 7 pages.

Patent Abstracts of Japan, Abstract of Japanese Patent "Tire Wear Detecting Device and Method", Publication No. 2006151269, Jun. 15, 2006, Japanese Application No. 2004346910, Filed Nov. 30, 2004.

* cited by examiner

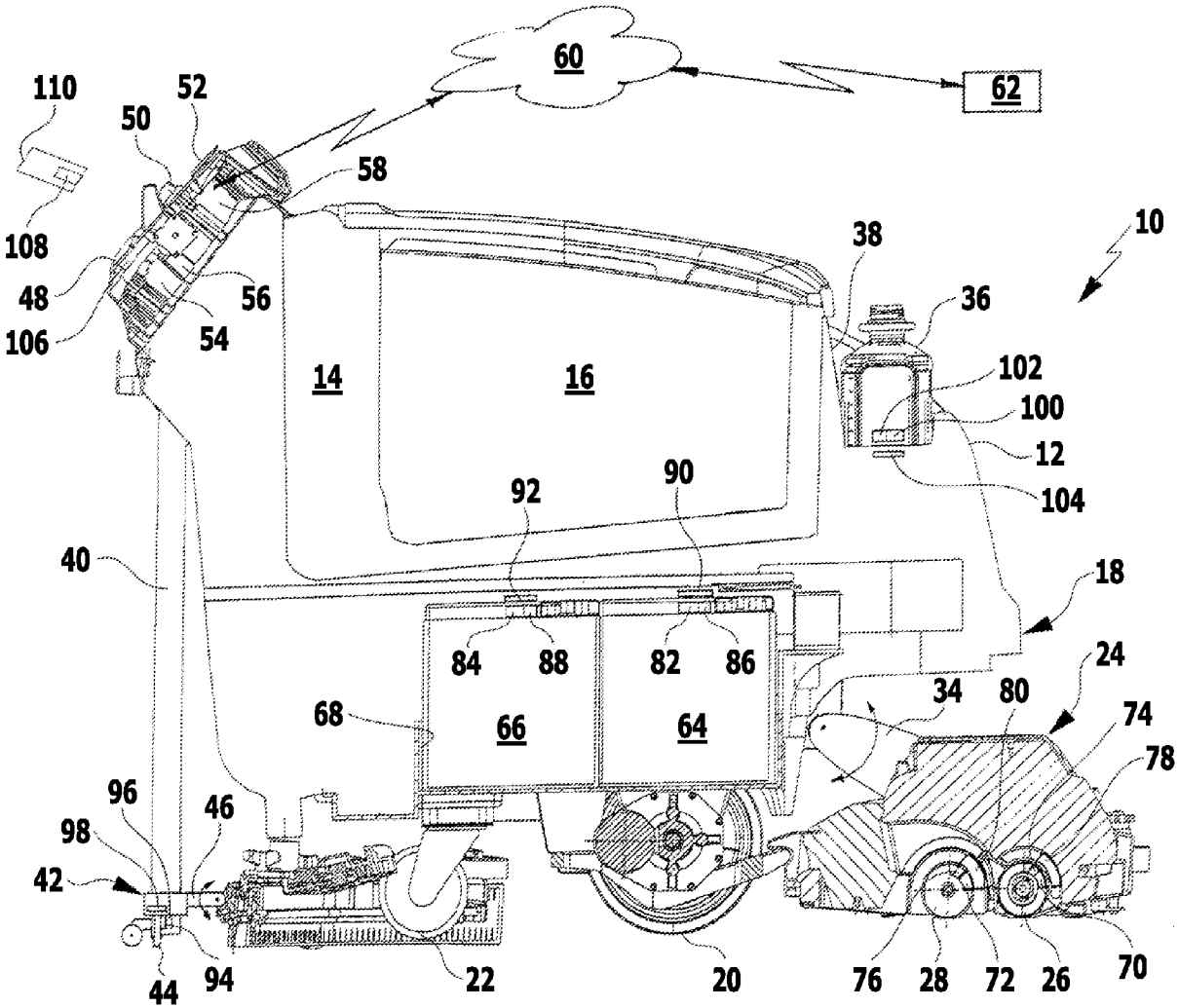
10
62
60
36
38
102
100
12
104
18
24
74
78
70
26
72
28
76
80
34
20
86
82
64
90
16
88
84
66
92
22
68
14
58
56
54
52
50
110
108
48
106
40
46
94
44
96
98
42

METHOD FOR OPERATING A CLEANING APPLIANCE AND CLEANING APPLIANCE FOR IMPLEMENTING THE METHOD

This application is a continuation of international application number PCT/EP2011/066695 filed on Sep. 26, 2011 and claims the benefit of German application number 10 2010 042 347.5 filed on Oct. 12, 2010, which are incorporated herein by reference in their entirety and for all purposes.

BACKGROUND OF THE INVENTION

The invention relates to a method for operating a cleaning appliance, in particular a floor cleaning appliance, which has a control device and at least one cleaning element for cleaning a surface, wherein the cleaning element has a local memory element and the control device comprises a control memory member and wherein the control device is connected to a reader for reading the local memory element.

In addition, the invention relates to a cleaning appliance for implementing the method.

For the purpose of cleaning a surface, in particular a floor surface, cleaning appliances are used which have at least one cleaning element. The cleaning element can be designed, for example, in the form of a sweeping or scrubbing brush or also in the form of a cleaning pad or, for example, also in the form of a suction lip, with the aid of which liquid can be taken up from the surface to be cleaned. The control of the cleaning appliance is brought about with the aid of a control device. The control device can be connected, for example, to a motor, for example an electric motor or a combustion engine which drives the at least one cleaning element. At least one cleaning element of the cleaning appliance comprises a memory element which can be read by an associated reader. The reader is in communication with the control device. This offers the possibility of reading data stored in the local memory element with the aid of the reader and communicating them to the control device.

It is suggested in DE 10 2007 050 351 A1 in this connection to store data which identify a cleaning tool in the local memory element. The memory element can be integrated into a transponder, i.e. into a radio communication element which records and answers incoming signals.

The at least one cleaning element of the cleaning appliance can normally be exchanged since it is subject to wear and tear during operation of the cleaning appliance and will therefore be worn down during the course of time. It must then be replaced by a new cleaning element of the same type. Often, different cleaning elements can also be used in one cleaning appliance. In this respect, the user must, however, take particular care that he uses only cleaning elements which are actually suitable for the specific cleaning appliance. If the user uses an unsuitable cleaning element, this can lead to a malfunctioning of the cleaning appliance or, however, also to an unsatisfactory cleaning result. There is also the risk of the surface to be cleaned being damaged by an unsuitable cleaning element.

The object of the present invention is to provide a method for operating a cleaning appliance of the type specified at the outset as well as a cleaning appliance for implementing the method, with which the risk of the user unintentionally using an unsuitable cleaning element is reduced.

SUMMARY OF THE INVENTION

This object is accomplished in accordance with the invention, in a method of the generic type, in that characteristic data distinguishing the type of cleaning element are stored in the local memory element, this data being read and evaluated in the period of time from the starting up of the cleaning appliance up to the beginning of the cleaning action of the cleaning element.

In the case of the method according to the invention, characteristic data which distinguish the type of cleaning element, i.e. the sort of cleaning element, will be stored in the local memory element of the cleaning element. If the cleaning appliance is started up, the data will be read from the local memory element of the cleaning element and so they are available to the control device of the cleaning appliance. The data will then be evaluated. The read-out of the data takes place during the period of time which begins with the starting up of the cleaning appliance and ends with the beginning of the actual cleaning action of the cleaning element. It may, for example, be provided for the local memory element of the at least one cleaning element to be read immediately the cleaning appliance is started up. In many cases, however, the starting up of the cleaning appliance and the beginning of the actual cleaning action of the cleaning element take place one after the other with respect to time and so the local memory element need not, in every case, be read at the same time as the cleaning appliance is started up. The read-out process should, however, be completed by the beginning of the actual cleaning action of the cleaning element as this offers the possibility of delaying the beginning of the cleaning action or even stopping it completely if the evaluation of the data read out results in the conclusion that the cleaning element is not suitable for the operation of the cleaning tool.

In many cases, the at least one cleaning element is held on a support structure of the cleaning appliance so as to be adjustable in height. For example, a cleaning brush, in particular a scrubbing brush, or a cleaning pad can be raised and lowered vertically. The beginning of the actual cleaning action is not brought about until the cleaning element has been lowered. The read-out of the characteristic data of the cleaning element can then take place, for example, up to the point in time, at which the cleaning element takes up its lowered position.

The at least one cleaning element is often held so as to be rotatable and can be turned about its axis of rotation by means of a drive motor. It is favorable with such configurations when the cleaning element turns about its axis of rotation during the read-out of the data as this ensures that the local memory element, which often extends only over a partial section of the circumference of the cleaning element, enters the detection area of the reader as a result of the rotation of the cleaning element and, as a result, can be read reliably.

As already mentioned, it may be ensured by the method according to the invention that for the operation of the cleaning appliance only cleaning elements are used which are also suitable for the respective cleaning appliance. This is ensured by the fact that the characteristic data of the cleaning element which is to be used are read and evaluated each time the cleaning appliance is started up.

It may be provided, for example, for the data read out to be compared with information stored in the control memory member and the cleaning appliance to be controlled as a function of the result of comparison. If the comparison results in the data read not being in conformity with information stored in the control memory member, the beginning of the actual cleaning action of the cleaning element can, for example, be prevented automatically by the control device.

Alternatively or in addition, information corresponding to the data read out can be displayed on a display unit of the cleaning appliance. This offers, for example, the possibility of indicating to the user on the display unit the type of cleaning element to be used. The user can then decide whether he would actually like to use this cleaning element or not. A warning can also be displayed if the cleaning element is intended to be used only for special cleaning procedures. For example, in the case of scrubber dryers different cleaning brushes can be used. A first type of brush can have a very abrasive action and serve to remove layers from floor coverings. For this purpose, corundum particles can be worked into the individual bristles of the cleaning brushes. However, very soft cleaning brushes can also be used for the gentle cleaning of certain floor coverings. If the user is shown the type of cleaning element to be used or at least a warning directed thereto on the display unit when the cleaning appliance is started up, at the latest when the actual cleaning action of the cleaning element begins, the user can stop the actual cleaning action in good time before the floor surface is damaged on account of a cleaning brush unsuitable for the intended cleaning procedure or only an inadequate cleaning result can be achieved.

It is favorable when the information displayed on the display unit is stored in the control memory member together with the time of the display. The control memory member can be read at a later point in time in order to check whether the information corresponding to the data read out have also, in fact, been displayed to the user. This offers, for example, the possibility of checking, in the case of any complaint, whether the cleaning appliance is equipped inadequately or whether an error in the handling of the cleaning appliance was present.

In order to characterize the type of cleaning element, the part number of the cleaning element specified by the manufacturer is memorized in the case of one advantageous embodiment of the method according to the invention. The type of cleaning element is clearly specified by its part number. The part number is specified at the time of manufacture of the cleaning element and stored in its local memory element.

In one particularly preferred configuration of the method, an identification number which individually distinguishes the cleaning element is memorized for the purpose of characterizing the type of cleaning element. The use of an identification number has the advantage that not only the type of cleaning element can be recorded but also the individual cleaning element can be recorded. This, on the other hand, offers the possibility of determining the period of use of a specific cleaning element. The period of use, on the other hand, can represent a measure for the wear and tear on the cleaning element and so it can be indicated to the user, when a predetermined degree of wear and tear is reached, that the cleaning element should be changed.

It may also be provided for operating parameters, which are necessary for the correct operation of the cleaning element, to be stored in the local memory element for the purpose of characterizing the type of cleaning element. The type of cleaning element can be characterized in a simple manner on the basis of the operating parameters of the cleaning appliance which are required for operation of the cleaning element. The cleaning element can, for example, be characterized by the required contact pressure which should be exerted on the cleaning element during the cleaning action and/or by the rotational speed of the cleaning element. The control device can determine the type of cleaning element based on such operating parameters and, for example, assess whether the cleaning element is suitable for the particular cleaning appliance.

As already mentioned, it is of advantage when the data read out are checked with respect to their admissibility for the cleaning appliance.

It may, for example, be provided for the data read out to be compared to admissible data stored in the control memory member. Characteristic data of cleaning elements, which are admissible for the respective cleaning appliance, can be stored in the control memory member by the manufacturer or also on the part of the user. These admissible data can then be compared with the data of the cleaning element actually being used which are read when the cleaning appliance is started up.

The evaluation of the data read out is, however, not associated in every case with a comparison with admissible data. It may also be provided for the data read out to be processed with the aid of a predetermined arithmetic algorithm and the result of the processing then used for the further evaluation.

In one advantageous embodiment of the method according to the invention, operating parameters required for the correct operation of the cleaning element are allocated to the data read out and these required operating parameters are compared with the operating parameters of the cleaning appliance currently on hand. If the current operating parameters of the cleaning appliance, for example the preselected contact pressure or the rotational speed or, for example, also the metering of a cleaning agent or a preselected water consumption, do not match the operating parameters which are required for the correct operation of the cleaning element, this can be indicated to the user, in particular a corresponding warning can be shown on a display unit of the cleaning appliance.

It is of particular advantage when the operating parameters of the cleaning appliance are adjusted as a function of the data read out. This offers the possibility of adapting the operating parameters of the cleaning appliance automatically to the operating parameters required for the correct operation of the cleaning element to be used. For example, the contact pressure, the rotational speed, the water consumption, the metering of a cleaning agent or also any other operating parameter can be adapted automatically by the control device, on the basis of the data read out, to the required operating parameters which result from the data of the cleaning element read when the cleaning appliance is started up.

Favorably, at least one of the operating parameters required for the correct operation of the cleaning element is displayed on a display unit of the cleaning appliance. The user can, as a result, check in a simple manner whether the required operating parameters match the operating parameters currently on hand.

It is of advantage when the data read out are stored in the control memory member together with the time of the readout. The control memory member can be read, for example, by maintenance personnel or also by the user himself and so it can be ascertained in a simple manner, at what point in time what type of cleaning element has been used for the cleaning appliance. It is favorable, in particular, in the case of any complaint when it can subsequently be ascertained, at what point in time what cleaning element was used.

Cleaning appliances are known, with which different user authorizations can be assigned to the users. This offers, for example, the possibility of assigning a different authorization to inexperienced auxiliary personnel than to trained qualified personnel. The different user authorizations allow the respective user different application measures; inexperienced auxiliary personnel can, as a result, carry out only certain application measures whereas trained qualified personnel are allowed a great number of application measures. In the case of such cleaning appliances it is of advantage when the data read from the memory element are compared with usage authorization data of the cleaning appliance. The usage authorization data can include, for example, whether the respective user is allowed to use a specific type of cleaning element or not. For example, in the case of a scrubber dryer it may be provided for inexperienced auxiliary personnel to be allowed to use only scrubbing brushes with a certain degree of hardness whereas trained qualified personnel are also allowed to use abrasive brushes which are used to remove the layers from floor coverings. The control device can register the type of cleaning element on the basis of the data read from the respective memory element of the cleaning element. On the basis of the user authorization data, the control device can then check whether the respective user is actually allowed to use the cleaning element. If this is not the case, a corresponding indication can be displayed on a display unit of the cleaning appliance and/or the beginning of the actual cleaning action can be stopped.

The cleaning elements are normally subject to wear and tear and, therefore, have to be changed after a certain time. For this purpose, new cleaning elements must often be ordered from a manufacturer or dealer. The ordering process is simplified in one advantageous embodiment of the method according to the invention in that ordering data of the cleaning element corresponding to the data read out are displayed on a display unit of the cleaning appliance. The ordering data can comprise, in particular, an ordering number for the respective cleaning element and so the ordering number can be displayed on the display device. The user can, therefore, read the ordering number of the cleaning element on the display unit and, when required, order a new cleaning element.

It is of particular advantage when the ordering data are communicated to an order acceptance facility via a telecommunication device of the cleaning appliance. A cell phone integrated into the cleaning appliance can be used, for example, as telecommunication device, with the aid of which the ordering data can be communicated wirelessly to an order acceptance facility of a manufacturer or dealer of the cleaning element.

The data read out and/or operating data corresponding to them can preferably be communicated by means of a telecommunication device of the cleaning appliance via a telecommunication network, for example via the internet and/or an intranet.

In one preferred configuration of the method according to the invention, at least one further component of the cleaning appliance, in particular a wearing or accessory part of the cleaning appliance, is equipped, in addition or alternatively to the at least one cleaning element, with a local memory element, in which data characterizing the type of the component and/or the degree of wear of the component are stored and read by means of a reader associated with the component and evaluated. With such a configuration of the method, the control unit can evaluate data of at least one component of the cleaning appliance. For example, a container which accommodates cleaning agent, in particular a bottle of cleaning agent, can be equipped with a local memory element, in which data characterizing the type of cleaning agent are stored. A reader can be associated with the container and this is connected to the control device of the cleaning appliance. The control device can recognize, as a result, which type of cleaning agent is currently available. This type of cleaning agent can be linked, for example, to the type of cleaning element which is intended to be used. As a result, the control device can check whether the cleaning agent currently available is suitable for the cleaning element to be used. If this is not the case, this can be indicated to the user prior to the beginning of the actual cleaning action and/or the beginning of the cleaning action can be stopped.

It may be provided for the cleaning appliance to have for the supply of energy at least one battery which is equipped with a local memory element which can be read by a reader associated with the battery. This offers the possibility of ascertaining the type of battery currently in use on the basis of the data characterizing the type of battery. The control device can, as a result, check in a simple manner whether the battery currently in use is suitable for the supply of energy to the cleaning appliance.

However, other components are also conceivable for equipping with a local memory element, e.g. drive motors, wheels, turbines, sliding contacts, pumps, braking devices and/or drive belts.

As mentioned at the outset, the invention also relates to a cleaning appliance for implementing the method specified above. The cleaning appliance comprises a control device and at least one cleaning element for cleaning a surface, wherein the cleaning element has a local memory element and the control device comprises a control memory member and is connected to a reader for reading the local memory element.

In order to develop the cleaning appliance further in such a manner that the risk of the user unintentionally using an unsuitable cleaning element is reduced, it is provided in accordance with the invention for characteristic data distinguishing the type of cleaning element to be stored in the local memory element, these data being read and evaluated automatically in the period of time from the starting up of the cleaning appliance up to the beginning of the cleaning action of the cleaning element.

As a result of the configuration of the cleaning appliance according to the invention, a check of the data characterizing the type of cleaning element can take place each time the cleaning appliance is started up. As already mentioned, this offers, for example, the possibility of checking the cleaning element provided for use as to its suitability before the actual cleaning action begins.

The cleaning appliance favorably comprises a display unit, on which information corresponding to the data read out can be displayed. This offers, for example, the possibility of displaying the type of cleaning element to the user prior to the beginning of the actual cleaning action and also a warning to the extent that the cleaning element currently provided for use is suitable only for specific purposes.

The data read out can be checked with respect to their admissibility in one advantageous embodiment of the cleaning appliance.

As already mentioned, it may, for example, be provided for the data read out to be compared with admissible data stored in the control memory member.

The admissible data stored in the control memory member can favorably be updated. For this purpose, the control memory member can be configured as a write/read memory, to which a writer/reader is allocated.

In one particularly preferred configuration of the cleaning appliance according to the invention, operating parameters of the cleaning appliance can be adjusted automatically as a function of the data read out. As a result, the operating parameters of the cleaning appliance can be adapted in a simple manner to the cleaning element being used each time.

It is favorable, in particular, with a view to possible complaints when the cleaning appliance has a memory, in which the data read out can be stored together with the time of the read-out.

Favorably, the information displayed on a display unit of the cleaning appliance and corresponding to the data read out can be stored in a memory of the cleaning appliance.

The data read from the local memory element can be compared with user authorization data in one advantageous embodiment of the cleaning appliance according to the invention. The user authorization data can, for example, authorize the use of different cleaning measures, for which different cleaning elements are required. As a result of the data characterizing the type of cleaning element being read when the cleaning appliance is started up, the control device can check prior to the beginning of the actual cleaning action on the basis of the user authorization data whether the current user is actually entitled to use the cleaning element. Inexperienced auxiliary personnel can, as a result, be prevented in a simple manner from using cleaning elements, for the use of which special knowledge is required which is normally only at the command of trained qualified personnel.

It is favorable when the cleaning appliance has a display unit, on which ordering data of the cleaning element corresponding to the data read out can be displayed. As already explained, this makes the ordering process of a cleaning element easier since the user can read the required ordering data, i.e., in particular, an ordering number, on the display unit in a simple manner.

It is particularly advantageous when the cleaning appliance comprises a telecommunication device for communicating the ordering data to an order acceptance facility.

The cleaning appliance favorably comprises a telecommunication device, with the aid of which the data read out and/or operating data corresponding to them can be communicated via a telecommunication network, in particular via the internet or an intranet.

The local memory element is advantageously integrated into a transponder, i.e. into a radio communication member which accepts and answers incoming signals. Such transponders facilitate a wireless communication of signals between the local memory element and the associated reader. The transponder comprises for this purpose a transmitting and receiving antenna which is in electrical communication with the local memory element. Such transponders are known per se to the person skilled in the art and do not, therefore, require more detailed comment.

It is of particular advantage when the cleaning appliance has, in addition or alternatively to the at least one cleaning element, at least one additional component with a local memory element, in particular a wearing or accessory part, wherein a reader connected to the control device is associated with the memory element and data characterizing the type of the component and/or the degree of wear of the component can be stored in the memory element. A container accommodating a cleaning agent can be used, for example, as accessory part. Data characterizing the type of cleaning agent can be stored in a memory member of the container, in particular in a transponder, and read by an associated reader. Batteries of the cleaning appliance can also each have a local memory element available, in which data characterizing the type of battery are stored.

The following description of one preferred embodiment of the invention serves to explain the invention in greater detail in combination with the drawing.

BRIEF DESCRIPTION OF THE DRAWING

The single FIGURE shows a cleaning appliance in accordance with the invention, using the example of a scrubber dryer.

DETAILED DESCRIPTION OF THE INVENTION

The scrubber dryer illustrated in the drawing is given, altogether, the reference numeral 10. It comprises in the customary manner a housing 12 which surrounds a fresh water tank 14 and a dirty water tank 16 and is arranged on a chassis 18 which can travel along a floor surface to be cleaned by means of wheels 20, 22. A cleaning head 24 with a first cleaning element in the form of a first scrubbing roller 26 and a second cleaning element in the form of a second scrubbing roller 28 is held on the chassis 18 on the underside. The two scrubbing rollers 26, 28 can be caused to rotate about a respective axis of rotation by an electric motor which is known per se and not illustrated in the drawing. They can be lifted away from the floor surface to be cleaned and placed on it by means of a first adjusting device 34. In this respect, the first adjusting device 34 can absorb some of the weight force of the cleaning head 24 when lowering the cleaning head 24 and so the contact pressure which is exerted on the floor surface to be cleaned by the scrubbing rollers 26, 28 can be adjusted by means of the first adjusting device 34.

Water from the fresh water tank 14 can be applied to the floor surface in the region of the cleaning head 24 in the normal manner via a plurality of outlet nozzles which are known per se and, therefore, not illustrated in the drawing in order to achieve a better overview, wherein a cleaning agent, which is stored in a cleaning agent container 36, can be mixed with the water. The cleaning agent container 36 is held on the housing 12 so as to be exchangeable. The housing has a receptacle 38, into which the cleaning agent container 36 can be inserted and from which it can be removed as required.

The dirty water tank 16 can be acted upon with a vacuum by means of a suction unit which is known per se and, therefore, not illustrated in the drawing in order to achieve a better overview. The dirty water tank 16 is in flow communication with a suction bar 42 via a suction line 40. The suction bar 42 comprises a replaceable suction lip 44 which represents a further cleaning element of the scrubber dryer 10. The suction bar 42 can be lifted away from the floor surface to be cleaned and lowered onto it by means of a second adjusting device 46. In the lowered state of the suction bar 42, the suction lip 44 slides along the floor surface to be cleaned. On account of the vacuum acting on the dirty water tank 16 and its flow connection to the suction bar 42, liquid will be taken up from the floor surface to be cleaned by means of the suction lip 44 and subsequently conveyed to the dirty water tank 16 via the suction line 40.

The scrubber dryer 10 comprises a control panel 48, on which a main switch 50 as well as a display unit in the form of a monitor 52 are arranged. Beneath the control panel 48, the scrubber dryer 10 has a control device 54 with a control memory member 56 which is designed as a non-volatile write/read memory. In addition, a telecommunication device in the form of a cell phone 58 is arranged beneath the control panel 48 and with the aid of this device a signal-conducting connection can be provided to a central order acceptance and monitoring facility 62 via a telecommunication network, namely via a cellular network 60 and/or the internet.

For the purpose of supplying energy, the scrubber dryer 10 has two batteries 64, 66 which are arranged in a battery compartment 68.

The two scrubbing rollers 26 and 28 each comprise a transponder 70 and 72, respectively, with a local memory element 74 and 76, respectively, in which characteristic data are stored which characterize the type of scrubbing roller 26 and 28, respectively.

In addition to the respective memory element 74 and 76, the transponders 70 and 72 comprise a respective transmitting and receiving coil which is known per se and, therefore, not illustrated in the drawing in order to achieve a better overview.

In the cleaning head 24, a respective reader 78, 80 is associated with the transponders 70 and 72, respectively, and with its aid the memory element 74 and 76, respectively, can be read. The readers 78 and 80 are in electrical communication with the control device 54 via connecting lines not illustrated in the drawing.

The two batteries 64 and 66 each have a transponder 82 and 84, respectively, with a local memory element 86 and 88, respectively, and a respective transmitting and receiving coil which is not illustrated in the drawing. A respective reader 90, 92 is associated with the transponders 82 and 84, respectively, and connected to the control device 54 via connecting lines which are not illustrated. The memory elements 86, 88 can be read by means of the readers 90 and 92. Data which characterize the type of battery 64 and 66, respectively, in use are stored in the respective memory elements 86, 88.

A further transponder 94 with a local memory element 96 is integrated into the suction lip 44 and the memory element 96 of the suction lip 44 can be read by means of a reader 98 arranged on the suction bar 42. Data which characterize the type of suction lip 44 are stored in the memory element 96. In particular, these data give information on whether the suction lip is oil resistant or it is a suction lip which is not oil resistant.

The cleaning agent container 36 has a transponder 100 with a local memory element 102 as well as a transmitting and receiving coil which is not illustrated in the drawing. The memory element 102 can be read by a reader 104 which is connected to the control device 54 via a connecting line not illustrated in the drawing and is arranged at the receptacle 38.

A further reader 106 is arranged on the control panel 48 and connected to the control device 54 via a connecting line which is not illustrated. It may also be provided for it to be integrated into the control device 54. The reader 106 serves the purpose of reading user authorization data from a memory element 108 of a portable authorization element 110. The user of the scrubber dryer 10 carries the authorization element 110 with him. When the scrubber dryer 10 is started up, the user lays the authorization element 110 on the control panel 48 so that corresponding user authorization data can be read to the user by means of the reader 106. Further details concerning this will be given in the following.

The user can first of all activate the reader 106 so that user authorization data can be read from the memory element 108 of the authorization element 110 and checked in the control device 54. With correct authorization, the user can then move the scrubber dryer 10 along a floor surface, wherein the cleaning head 24, like the suction bar 42, takes up its raised position first of all. As a result of actuation of an operating element which is not shown in the drawing, the user can then lower the cleaning head 24 and the suction bar 42 onto the floor surface to be cleaned. The two scrubbing rollers 26 and 28 are caused to rotate and the dirty water tank 16 is acted upon with a vacuum by means of the suction unit not illustrated in the drawing and so the actual cleaning action can begin.

During the period of time between the starting up of the scrubber dryer 10 as a result of actuation of the main switch 50 and the lowering of the cleaning head 24 and the suction bar 42, the data stored in the memory elements 74, 76 of the two scrubbing rollers 26, 28 are read and also the data stored in the memory element 96 of the suction lip 44. These data are evaluated by the control device 44. On the basis of the characteristic data, the control device recognizes the type of scrubbing rollers 26, 28 in use and also the type of suction lip 44 in use.

During the period of time between the starting up of the scrubber dryer 10 and the actual beginning of the cleaning action, the memory elements 86, 88 of the batteries 64, 66 are also read and also the memory element 102 arranged on the cleaning agent container 36. The data stored therein are also evaluated by the control device 24.

The evaluation of the data read out takes place to the extent that the control device 54 checks, on the one hand, on the basis of the user authorization data relayed by the reader 106 whether the respective user is authorized to use the scrubbing rollers 26, 28 and the suction lip 44. In addition, the control device 54 checks on the basis of the data read out whether the current operating parameters of the scrubber dryer 10, in particular the contact pressure which is exerted by the cleaning head 24 on the scrubbing rollers 26, 28, correspond to the operating parameters which are required for the correct operation of the scrubbing rollers 26, 28. The control device determines the required operating parameters on the basis of the data of the scrubbing rollers 26, 28 which have been read. For this purpose, the control device 54 has a data base, in which the required operating parameters for a plurality of data are listed.

Insofar as the operating parameters required for the correct operation of the scrubbing rollers 26, 28 do not match the current operating parameters of the scrubber dryer 10, the control device 54 adapts the current operating parameters to the required operating parameters.

When the scrubber dryer is started up, the control device 54 checks on the basis of the characteristic data of the batteries 64 and 66 whether these batteries are admissible for the operation of the scrubber dryer 10. In addition, the control device 54 checks on the basis of the characteristic data of the cleaning agent container 36 whether the cleaning agent located therein is admissible for the operation of the scrubber dryer 10. The actual cleaning action is not started until all the admissibility checks have had a positive result.

If an inadmissibility is present or if the current operating parameters cannot be adapted to the required operating parameters or if the check of the user authorization results in the user not being authorized to use the scrubbing rollers 26, 28 currently in use and the suction lip 44 currently in use, this is indicated to the user on the monitor 52. Moreover, the actual cleaning action is then stopped in that both the cleaning head 24 and the suction bar 42 remain in their lifted positions. The information displayed on the monitor 52 on the basis of the data read out is stored in the control memory member 56 together with the time of the display. In addition, the data read during the starting up of the scrubber dryer 10 are also stored in the control memory member 56 together with the time of the read-out. These data can be read again at a later time, in particular in the case of any complaint.

The scrubbing rollers 26, 28 like the suction lip 44 are subject to wear and tear. During the course of time they must, therefore, be replaced. In order to simplify the ordering procedure, ordering data, in particular ordering numbers, which correspond to the data read can, for this purpose, be displayed on the monitor 52. The user can then initiate an ordering procedure at the control panel 58 by entering a corresponding control command and the ordering data will be communicated to the order acceptance and monitoring facility 62 by means of the cell phone 58 via the internet 60. The data read out can also be communicated directly to the order acceptance and monitoring facility 62 with the aid of the cell phone 58. This offers the possibility of recording the scrubbing rollers 26, 28 currently being used for the scrubber dryer 10 as well as the suction lip 44 in use and the batteries 64, 66 in use as well as the cleaning agent container 36 located in the receptacle 38 within the scope of a remote servicing and remote inspection.

The read-out of the data explained above takes place each time the scrubber dryer 10 is started up and it can be ensured in a simple manner as a result of the subsequent checking of the characteristic data that the scrubbing rollers 26, 28 in use as well as the suction lip 44 in use are admissible for the operation of the scrubber dryer 10 and that the operating parameters of the scrubber dryer 10 correspond to the operating parameters which are required for the correct operation of the scrubbing rollers 26, 28 and the suction lip 44. In addition, it is ensured by way of the reading and evaluation of the characteristic data during each starting up of the scrubber dryer 10 that the actual cleaning action will begin only when the user is authorized to use the current scrubbing rollers 26, 28 and the suction lip 44.

The invention claimed is:

1. Method for operating a floor cleaning appliance, the floor cleaning appliance comprising a control device, at least one cleaning element for cleaning a surface, the cleaning element comprising a local memory element, the control device comprising a control memory member, and a reader for reading the local memory element connected to the control device, the method comprising:

storing characteristic data distinguishing a type of cleaning element in the local memory element, reading and evaluating said data in a period of time from a starting up of the cleaning appliance up to a beginning of a cleaning action of the cleaning element, and comparing the data read out with user authorization data.

2. Method as defined in claim 1, further comprising comparing the data read out to information stored in the control memory member and controlling the cleaning appliance as a function of a result of the comparison.

3. Method as defined in claim 1, further comprising displaying information corresponding to the data read out on a display unit of the cleaning appliance.

4. Method as defined in claim 3, further comprising storing the information displayed on the display unit in the control memory member together with a time of the display.

5. Method as defined in claim 1, wherein in order to characterize the type of cleaning element, a part number specified by the manufacturer for the cleaning element is stored in the memory element.

6. Method as defined in claim 1, wherein in order to characterize the type of cleaning element, an identification number individually distinguishing the cleaning element is stored in the memory element.

7. Method as defined in claim 1, wherein in order to characterize the type of cleaning element, operating parameters required for correct operation of the cleaning element are stored in the memory element.

8. Method as defined in claim 1, wherein the data read out are checked with respect to their admissibility for the cleaning appliance.

9. Method as defined in claim 8, wherein the data read out are compared to admissible data stored in the control memory member.

10. Method as defined in claim 1, wherein operating parameters required for the correct operation of the cleaning element are allocated to the data read out and the required operating parameters are compared with the operating parameters of the cleaning appliance currently on hand.

11. Method as defined in claim 10, wherein at least one of the operating parameters required for the correct operation of the cleaning element is displayed on a display unit of the cleaning appliance.

12. Method as defined in claim 1, wherein operating parameters of the cleaning appliance are adjusted as a function of the data read out.

13. Method as defined in claim 1, further comprising storing the data read out in the control memory member together with a time of the read-out.

14. Method as defined in claim 1, wherein ordering data of the cleaning element corresponding to the data read out are displayed on a display unit of the cleaning appliance.

15. Method as defined in claim 14, wherein the ordering data are communicated to an order acceptance facility via a telecommunication device of the cleaning appliance.

16. Method as defined in claim 1, wherein in addition or alternatively to the at least one cleaning element, at least one additional component comprising at least one of a wearing part and accessory part, is equipped with a local memory element, further data characterizing at least one of a type of the component and a degree of wear of the component being stored in said memory element, said further data being read and evaluated in the period of time from the starting up of the cleaning appliance up to the beginning of the cleaning action of the cleaning element.

17. Cleaning appliance, comprising:

a control device, at least one cleaning element for cleaning a surface, said cleaning element comprising a local memory element, the control device comprising a control memory member, and a reader for reading the memory element connected to the control device, wherein:

characteristic data distinguishing a type of cleaning element are stored in the local memory element, said data being read by the reader and evaluated automatically by the control device in a period of time from a starting up of the cleaning appliance up to a beginning of a cleaning action of the cleaning element, and the control device is adapted to compare the data read out with user authorization data.

18. Cleaning appliance as defined in claim 17, further comprising a display unit for displaying information corresponding to the data read out by the reader.

19. Cleaning appliance as defined in claim 17, wherein the control device is adapted to check the data read out as to their admissibility.

20. Cleaning appliance as defined in claim 17, wherein the control device is adapted to compare the data read out with admissible data stored in the control memory member.

21. Cleaning appliance as defined in claim 17, wherein the control device is adapted to adjust operating parameters of the cleaning appliance automatically as a function of the data read out.

22. Cleaning appliance as defined in claim 17, wherein the data read out are storable in the control memory member together with a time of the read-out.

23. Cleaning appliance as defined in claim 17, further comprising a display unit for displaying ordering data of the cleaning element corresponding to the data read out by the reader.

24. Cleaning appliance as defined in claim 23, further comprising a telecommunication device for communicating the ordering data to an order acceptance facility.

25. Cleaning appliance as defined in claim 17, further comprising a telecommunication device, with the aid of which at least one of the data read out and operating data of the cleaning appliance corresponding to the data read out are transmittable via a telecommunication network.

26. Cleaning appliance as defined in claim 17, wherein the local memory element is integrated into a transponder.

27. Cleaning appliance as defined in claim 17, comprising, in addition or alternatively to the at least one cleaning element, at least one additional component with a local memory element, the at least one additional component comprising at least one of a wearing part and an accessory part, wherein the reader connected to the control device is associated with the memory element and further data characterizing at least one of a type of the additional component and a degree of wear of the additional component are storable in the memory element.

* * * * *